US010301163B2

(12) United States Patent
DeRuntz

(10) Patent No.: US 10,301,163 B2
(45) Date of Patent: May 28, 2019

(54) BEVERAGE EXTRACTOR WITH CONTAINER DISENGAGEMENT FEATURE

(71) Applicant: Coravin, Inc., Burlington, MA (US)

(72) Inventor: Otto DeRuntz, Dunstable, MA (US)

(73) Assignee: Coravin, Inc., Burlington, MA (US)

( * ) Notice: Subject to any disclaimer, the term of this patent is extended or adjusted under 35 U.S.C. 154(b) by 0 days.

(21) Appl. No.: 16/048,429

(22) Filed: Jul. 30, 2018

(65) Prior Publication Data

US 2019/0031486 A1 Jan. 31, 2019

Related U.S. Application Data

(60) Provisional application No. 62/538,955, filed on Jul. 31, 2017.

(51) Int. Cl.

| | |
|---|---|
| ***B67D 1/04*** | (2006.01) |
| ***B67D 1/08*** | (2006.01) |
| ***B67D 1/00*** | (2006.01) |
| *B67D 1/14* | (2006.01) |
| *B67D 1/12* | (2006.01) |

(52) U.S. Cl.

CPC ..... *B67D 1/0412* (2013.01); *B67D 1/0004* (2013.01); *B67D 1/0885* (2013.01); *B67D 1/0007* (2013.01); *B67D 1/0418* (2013.01); *B67D 1/0884* (2013.01); *B67D 1/1252* (2013.01); *B67D 1/14* (2013.01); *B67D 2001/0093* (2013.01); *B67D 2001/0481* (2013.01)

(58) Field of Classification Search

CPC ..... B67D 1/0412; B67D 1/0885; B67D 2001/0481

See application file for complete search history.

(56) References Cited

U.S. PATENT DOCUMENTS

| | | | | |
|---|---|---|---|---|
| 3,164,280 A | | 1/1965 | Ford | |
| 4,850,387 A | * | 7/1989 | Bassill | B67D 1/0412 137/212 |
| 4,934,543 A | * | 6/1990 | Schmidt | B65D 85/73 215/228 |

(Continued)

FOREIGN PATENT DOCUMENTS

| | | |
|---|---|---|
| EP | 0 420 561 A1 | 4/1991 |
| WO | WO 2009/116093 A1 | 9/2009 |

OTHER PUBLICATIONS

International Search Report and Written Opinion for International Application No. PCT/US2018/044316, dated Oct. 30, 2018.

*Primary Examiner* — Donnell A Long

(74) *Attorney, Agent, or Firm* — Wolf, Greenfield & Sacks, P.C.

(57) ABSTRACT

Devices and methods for extraction of a beverage from a beverage bottle, such as a wine bottle, using an extraction device. A clamp of the extraction device may include a container engagement surface arranged to disengage the clamp from the container neck when the clamp is pulled upwardly relative to the container neck. The container engagement surface may include a surface that slopes upwardly and outwardly relative to the container neck and that moves the clamp radially outwardly and away from the container neck as the clamp is moved vertically upwardly relative to the container neck.

18 Claims, 11 Drawing Sheets

(56) References Cited

U.S. PATENT DOCUMENTS

| | | | | |
|---|---|---|---|---|
| 4,982,879 | A * | 1/1991 | Corrado | B67D 1/0412 222/399 |
| 4,984,711 | A * | 1/1991 | Ellis | B67B 7/26 222/152 |
| 9,422,144 | B2 * | 8/2016 | Lambrecht | B67D 1/0412 |
| 2010/0006603 | A1 * | 1/2010 | Weinberg | B67D 1/0418 222/152 |
| 2011/0049193 | A1 * | 3/2011 | Muller Kubold | B67D 1/0412 222/399 |
| 2013/0292423 | A1 | 11/2013 | Lambrecht | |
| 2014/0124530 | A1 * | 5/2014 | Craft | B67D 1/0412 222/23 |
| 2014/0252046 | A1 * | 9/2014 | Rider | B67D 1/0004 222/399 |
| 2014/0263477 | A1 * | 9/2014 | Kennedy | B67D 1/0082 222/545 |
| 2015/0001256 | A1 | 1/2015 | Kohls et al. | |
| 2015/0210523 | A1 * | 7/2015 | Witte | B67D 1/0462 222/394 |

* cited by examiner

BEVERAGE EXTRACTOR WITH CONTAINER DISENGAGEMENT FEATURE

CROSS REFERENCE TO RELATED APPLICATION

This application claims the benefit of U.S. Provisional Application No. 62/538,955, filed Jul. 31, 2017, which is hereby incorporated by reference in its entirety.

BACKGROUND OF INVENTION

This invention relates generally to the dispensing or other extraction of fluids from within a container, e.g., the dispensing of wine from a wine bottle.

SUMMARY OF INVENTION

One or more embodiments in accordance with aspects of the invention allow a user to withdraw or otherwise extract a beverage, such as wine, from within a container that is sealed by a cork, plug, elastomeric septum or other closure without removing the closure. In some cases, removal of liquid from such a container may be performed one or more times, yet the closure may remain in place during and after each beverage extraction to maintain a seal for the container. Thus, the beverage may be dispensed from the bottle multiple times and stored for extended periods between each extraction with little or no effect on beverage quality. In some embodiments, little or no gas, such as air, which is reactive with the beverage may be introduced into the container either during or after extraction of beverage from within the container. Thus, in some embodiments, a user may withdraw wine from a wine bottle without removal of, or damage to, the cork, and without allowing air or other potentially damaging gasses or liquids entry into the bottle.

In one aspect of the invention, a beverage extraction device includes a body including a conduit arranged to receive a flow of beverage under pressure from a beverage container and to dispense the beverage at a dispensing outlet of the conduit. For example, the conduit may include one or more tubes or passageways that receive beverage under pressure from a container, such as a wine bottle. The conduit may include a needle in some embodiments that is passed through a cork or other closure of the container to receive beverage. The dispensing outlet may be arranged to dispense beverage into a user's cup or glass. A clamp may be attached to the body and arranged to engage a container neck to secure the body relative to the container neck. For example, the clamp may include one or more clamp arms arranged to engage the container neck and secure the body so that lifting the body can lift both the body and the engaged container. This may allow a user to pour beverage from the container by manipulating the body alone. In other arrangements, the clamp may secure the body to the container so that the device is suspended from or otherwise secured to the container without other support. In some embodiments, the clamp may include a container engagement surface that slopes outwardly and upwardly relative to the container neck and is arranged to disengage the clamp from the container neck as the clamp is pulled upwardly relative to the container neck. In embodiments where the clamp includes a clamp arm, the engagement surface may be arranged to contact the container neck, e.g., at a lip of a bottle, and move the clamp arm radially away from the container neck with upward movement of the engagement surface relative to the container neck. This may aid in disengaging the clamp arm from the container neck. Thus, the container engagement surface may be arranged to contact a lip of a container and exert a radially outward force on the clamp to move the clamp away from the lip of the container as the clamp is moved upwardly relative to the container neck.

In some embodiments, the container engagement surface may be arranged to contact the container neck and exert a radially inward force on the container neck. For example, when the clamp is engaged with the container neck, the engagement surface may contact the neck and help the clamp grip the container neck such as by exerting a radially inward force on the neck. In some embodiments, the container engagement surface extends vertically, e.g., on a clamp arm. Vertical extension of the engagement surface is intended to refer to extension generally in a direction of a longitudinal axis of a container or container neck, or for example, generally in a direction of a longitudinal axis of a needle if a needle is used to access beverage in the container.

In some embodiments, the clamp arm may include two clamp arms that are opposed to each other and arranged to engage the container neck with the container neck positioned between the arms. Each arm may include a container engagement surface, e.g., that extends vertically on the respective arm as well as outwardly and upwardly. The device may include a base, where the two arms are movably mounted to the base such that the arms can be moved towards and away from each other. For example, the arms may be spring biased to move toward each other, e.g., so that distal ends of the clamp arms are biased to move together to clamp a container neck between the arms. In some cases, the base may include a stop arranged to contact a top of the container neck positioned between the arms. This stop may help suitably position the base and clamp relative to the container neck, as well as function as a guide for a needle, if used. The arms may be pivotally mounted to the base on a proximal side of the arms and the container engagement surfaces may be located on a distal side of the arms. In some cases, the clamp arms may include ridges that are located proximally of the container engagement surfaces and arranged to contact the container neck and help engage the container neck, e.g., by resisting movement of the container neck relative to the base. The engagement surfaces may exert a force on the container neck, e.g., at a lip of a bottle, that not only has a radially inward component, but also has a generally upward and inward component. This may help urge the clamp downwardly relative to the container neck, and help keep the stop in contact with the top of the neck.

In some embodiments, the body may be mounted for slidable movement relative to the base. For example, if the body includes a needle extending downwardly from the body and arranged for insertion through a closure of the container, downward movement of the body relative to the base may be employed to insert the needle through a container cork or other closure. In some arrangements, the clamp may be first engaged with a container neck, and then the body and needle moved downwardly, optionally guided by a needle guide on the base, to insert the needle through a closure of the container. After dispensing is complete, the body may be moved upwardly relative to the base to remove the needle from the closure. This may occur while the clamp remains engaged with the container neck. In some cases, upward force on the body moves the body upwardly relative to the base, and moves the base and clamp arms upwardly relative to a container neck engaged by the arms. This upward movement of the base and clamp arms may cause the engagement surfaces to contact the container neck and help removal of the clamp from the container, e.g., by moving the clamp arms away from the container neck, by guiding a lip of the container neck to pass by ridges or other features of the clamp arms, etc.

In some embodiments, the device may include a source of pressurized gas arranged to deliver pressurized gas into a beverage container. The conduit may be fluidly coupled to the beverage container to receive the flow of beverage under pressure caused by the pressurized gas in the beverage container. A valve may be arranged to control a flow of pressurized gas into the beverage container or to control the flow of beverage under pressure from the beverage container. For example, if the device includes a needle arranged to be inserted through a closure of a beverage container to deliver the pressurized gas into the beverage container, a valve may be used to control flow of pressurized gas into the needle, and/or to control flow of beverage under pressure from the beverage container through the conduit.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Figure 1:
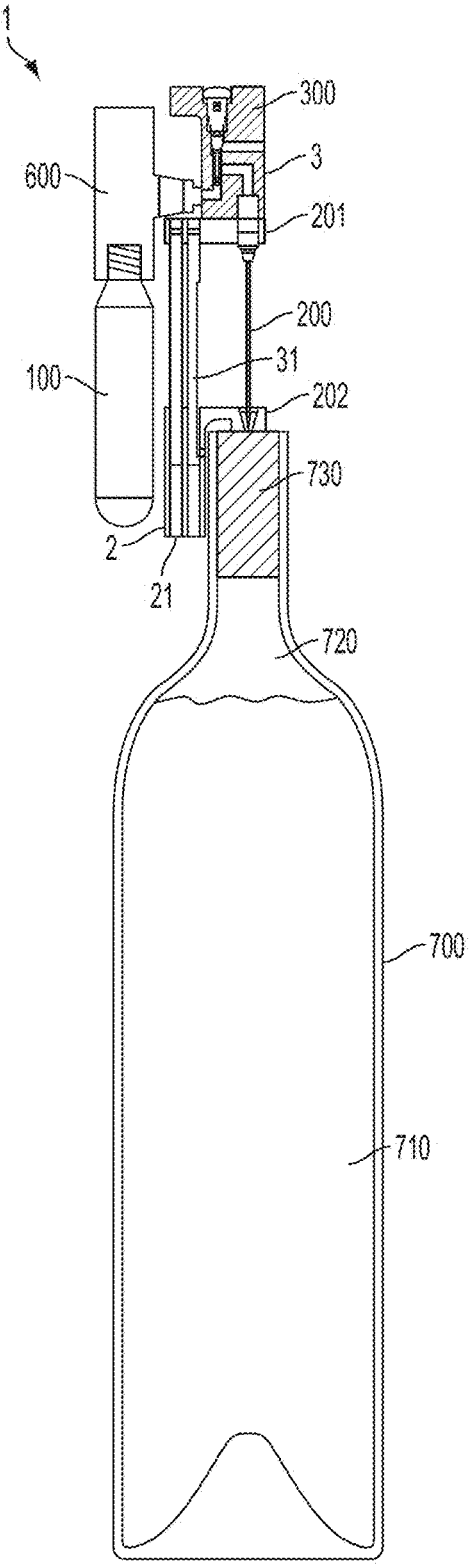
FIG. 1 shows a sectional side view of a beverage extraction device in preparation for introducing a needle through a closure of a beverage container.

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

FIGS. 1-4 show schematic views of one embodiment of a beverage extraction device 1 that may incorporate one or more aspects of the invention. This illustrative system 1 includes a body 3 with an attached pressurized source of gas 100 (such as a compressed gas cylinder) that provides gas under pressure (e.g., 2600 psi or less as dispensed from the cylinder) to a regulator 600. In this arrangement, the cylinder 100 is secured to the body 3 and regulator 600 by a threaded connection, although other configurations are possible, such as those described below and/or in U.S. Pat. Nos. 4,867,209; 5,020,395; and 5,163,909 which are hereby incorporated by reference with respect to their teachings regarding mechanisms for engaging a gas cylinder with a cylinder receiver. The regulator 600 is shown schematically and without detail, but can be any of a variety of commercially available or other single or multi-stage pressure regulators capable of regulating gas pressures to a pre-set or variable outlet pressure. The main function of the regulator 600 is to provide gas at a pressure and flow rate suitable for delivery to the container 700 (such as a wine bottle), e.g., so that a pressure established inside the container 700 does not exceed a desired level.

In this embodiment, the body 3 also includes a valve 300 operable to control the flow of gas from the regulator 600. The valve 300 may be a 3-way toggle valve that includes a single operation button and functions to selectively introduce pressurized gas into the container 700 and extract beverage 710 (such as wine) from the container 700 via a needle 200. Details regarding the operation of such a valve 300 are provided in U.S. Pat. No. 8,225,959, which is incorporated by reference in its entirety. Of course, other valve arrangements for controlling pressurized gas and beverage flow are possible. For example, the 3-way valve 300 could be replaced with a pair of on/off valves, one for controlling gas introduction to the container 700, and another for controlling flow of beverage from the container 700. Each valve could have its own actuator, allowing a user to selectively open and close the valves, whether individually or simultaneously. In short, details regarding the operation of the regulator 600 and valve 300 or other mechanisms for introducing gas into a container, and removing beverage from the container 700 are not necessarily limitations on aspects of the invention and may be modified as suitable.

To introduce gas into the container 700 and extract beverage, a needle 200 attached to the body 3 is inserted through a cork or other closure 730 that seals an opening of the container 700. This illustrative system 1 uses a pencil-tip non-coring needle 200 with a needle opening 220 along a sidewall of the needle near the needle tip. While the needle 200 may be inserted into the cork or other closure 730 in different ways, in this embodiment, the system 1 includes a base 2 with a pair of channels 21 that receive and guide movement of respective rails 31 of the body 3. Thus, movement of the body 3 and attached needle 200 relative to the container closure 730 may be guided by the base 2, e.g., the body 3 may slide vertically relative to the base 2 to move the needle 200 into/out of the closure 730. In addition, movement of the needle 200 may be guided by a needle guide 202 that is attached to the base 2 and positioned over the closure 730. Other arrangements for guiding movement of the body 3 relative to the base 2 are possible, such as providing one or more rails on the base 2 which engage with a channel or other receiver of the body 3, providing an elongated slot, channel or groove on the body or base which engages with a corresponding feature (e.g., a tab) on the other of the body or base and allows for sliding movement, a linkage that connects the body and base together and allows for movement of the body to insert the needle into the closure, and others.

In some embodiments, the base 2 may be fixed or otherwise held in place relative to the container 700, e.g., by a clamp arm, sleeve, strap or other device that engages with the container 700. Clamp arrangements in accordance with aspects of the invention are described in more detail below and may be used to temporarily or releasably secure the device 1 to a wine bottle neck or other container 700. By restraining movement of the base 2 relative to the container 700, such an arrangement may help guide motion of a needle 200 relative to the container 700 when penetrating a closure 730, or when being withdrawn from the closure 730. Alternately, the container 700 may be manipulated by grasping and manipulating the device 1 since the clamp engaging the device 1 to the container 700 may securely hold the device 1 and container 700 together.

Figure 2:
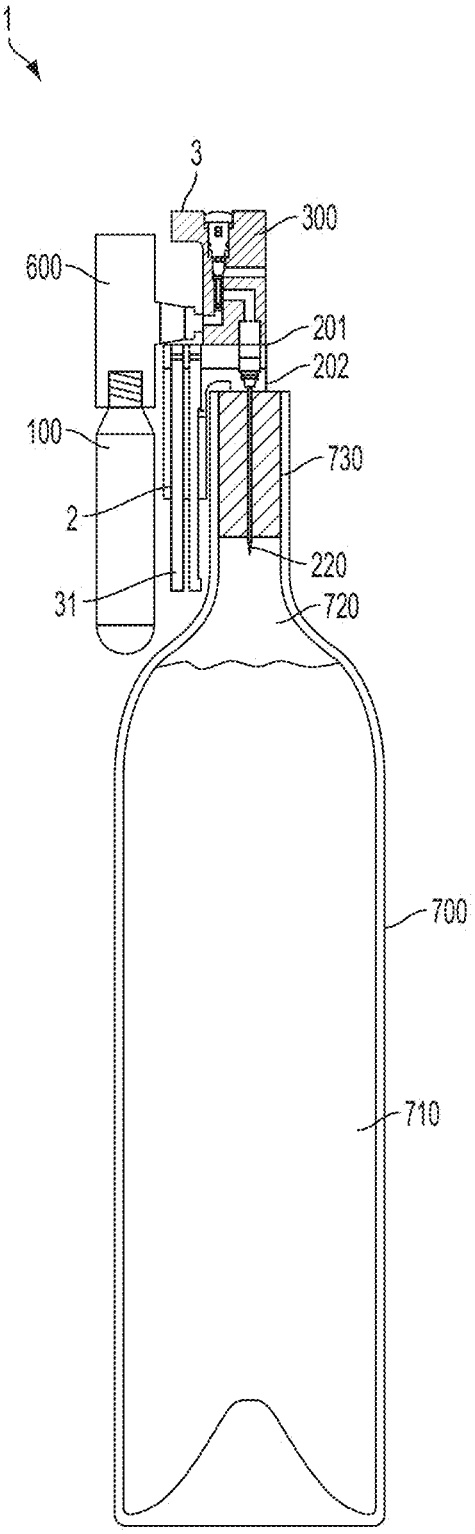
FIG. 2 shows the FIG. 1 embodiment with the needle passed through the closure.
Figure 3:
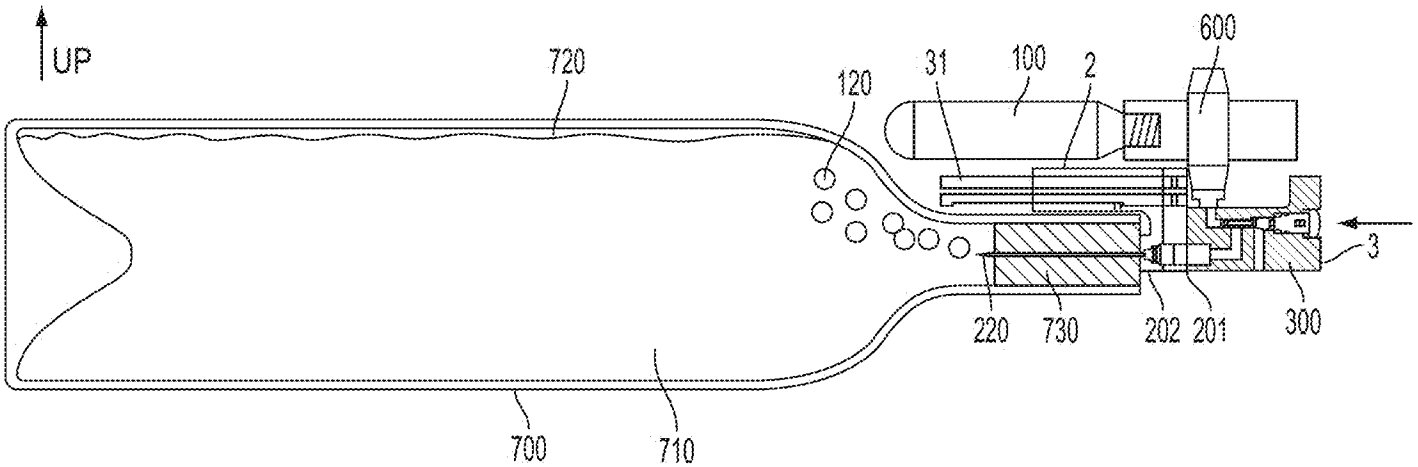
FIG. 3 shows the FIG. 1 embodiment while introducing gas into the container.
Figure 4:
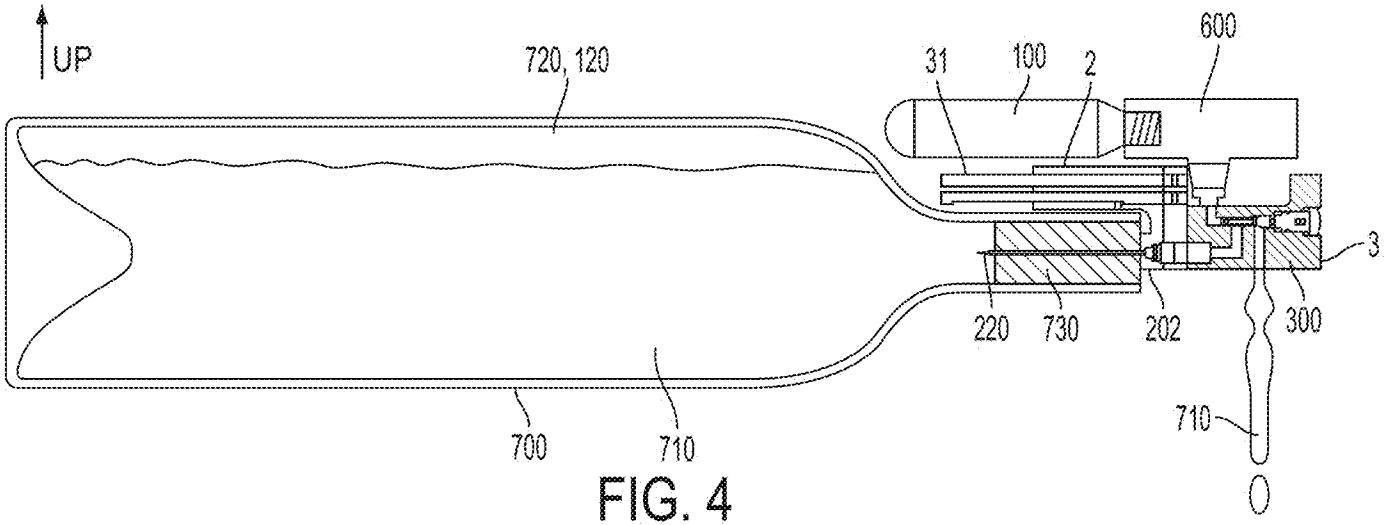
FIG. 4 shows the FIG. 1 embodiment while dispensing beverage from the container.

To insert the needle 200 through the closure 730, a user may push downwardly on the body 3 while maintaining the base 2 and the container 700 at least somewhat stationary relative to each other. The needle 200 will pass through the closure 730, guided in its motion, at least in part, by the guided motion of the body 3 relative to the base 2 (e.g., by the rails 31 and channels 21). With the needle 200 suitably inserted as shown in FIG. 2, a needle opening 220 at the needle tip may be positioned below the closure 730 and within the enclosed space of the container 700. The container 700 may then be tilted, e.g., so that the beverage 710 flows to near the closure 730 and any air or other gas 720 in the container 700 flows away from the closure. Pressurized gas 120 may then be introduced into the container 700 by actuating the valve 300 and causing gas from the cylinder 100 to flow through the valve 300 and needle 200 to exit at the needle opening 220, as shown in FIG. 3. Alternately, pressurized gas 120 can be introduced into the container 700 prior to tilting of the container, followed by tilting and dispensing of beverage. Thereafter, the valve 300 may be operated to stop the flow of pressurized gas and allow beverage 710 to flow into the needle opening 220 and through the needle 200 to be dispensed from the valve 300, as shown in FIG. 4. Thus, beverage may flow through a conduit of the body 3 that in this embodiment includes the needle 200, passageways in the body 3, and the valve 300. Of course, other arrangements for a conduit of a body 3 to conduct the flow of beverage are possible.

As discussed above, a beverage extraction device may include a clamp configured to engage the device with a container, e.g., by clamping the device to the neck of a bottle. For example, the device can include one or more clamp arms that are movably mounted to the device and are arranged to engage with a container to support the device on the container during use. In accordance with an aspect of the invention, a clamp may include a container engagement surface that is arranged to help disengage the clamp from a container neck as the clamp is pulled upwardly relative to the container neck. This arrangement may allow a user to easily remove the extraction device from the container. For example, the extraction device may include a needle that is inserted through a cork or other closure to extract beverage, and once dispensing is complete, the needle may be pulled upwardly from the cork. In some embodiments, the container engagement surface may allow a user to remove the clamp from the container neck and a needle from the closure in one operation. In some cases, a user may pull a needle upwardly from a cork which removes the needle from the cork and then pulls upwardly on the clamp relative to the container neck. This upward force on the clamp may cause the container engagement surface to engage the container neck, e.g., at a lip of the neck, and help disengage the clamp from the neck as the clamp is moved upwardly relative to the neck. In some embodiments, the container engagement surface may move the clamp away from the container neck. For example, the engagement surface may be sloped upwardly and outwardly relative to the container neck (e.g., at the lip) so that as the clamp is moved upwardly relative to the container neck, the container neck will contact the engagement surface and push outwardly on the engagement surface. This may move portions of the clamp away from the neck, helping to disengage the clamp from the container neck.

FIGS. 5-10 show a illustrative embodiment of a beverage extraction device 1 that incorporates aspects of the invention. This embodiment is similar in operation to that of FIGS. 1-4, but has a few different features. In this embodiment, the body 3 includes a handle 33, that may be gripped by a user for moving the body 3 relative to the base 2 in upward and downward motions to insert a needle 200 through a cork or other closure of a container 700. Also, a lever 32 is provided for operating the valve 300, e.g., to dispense beverage from a dispensing outlet 301 of a conduit of the body 3 and/or deliver gas to the container 700 via the needle 200. To allow movement of the body 3 relative to the base 2, e.g., in a vertical direction, the body 3 includes a rail 31 that has T-shaped cross section, and is arranged to move within a T-shaped receiving slot or channel 21 of the base 2. As discussed above, however, other arrangements are possible for engaging the body 3 and base 2 while allowing for movement of the needle 200. Also, a gas cylinder cover 101 threadedly engages with the body 3 at the regulator 600 to engage and hold the cylinder 100 in place relative to the body 3. (A gas cylinder cover 101 in this embodiment is a kind of cap that covers the gas cylinder 100 and threadedly engages with another part of the body 3 to hold the gas cylinder 100 in place.) This arrangement of a gas cylinder cover 101 allows for the use of gas cylinders 100 that do not threadedly engage with the regulator 600, but rather are held in engagement with the regulator 600 by the cover 101.

Figure 5:
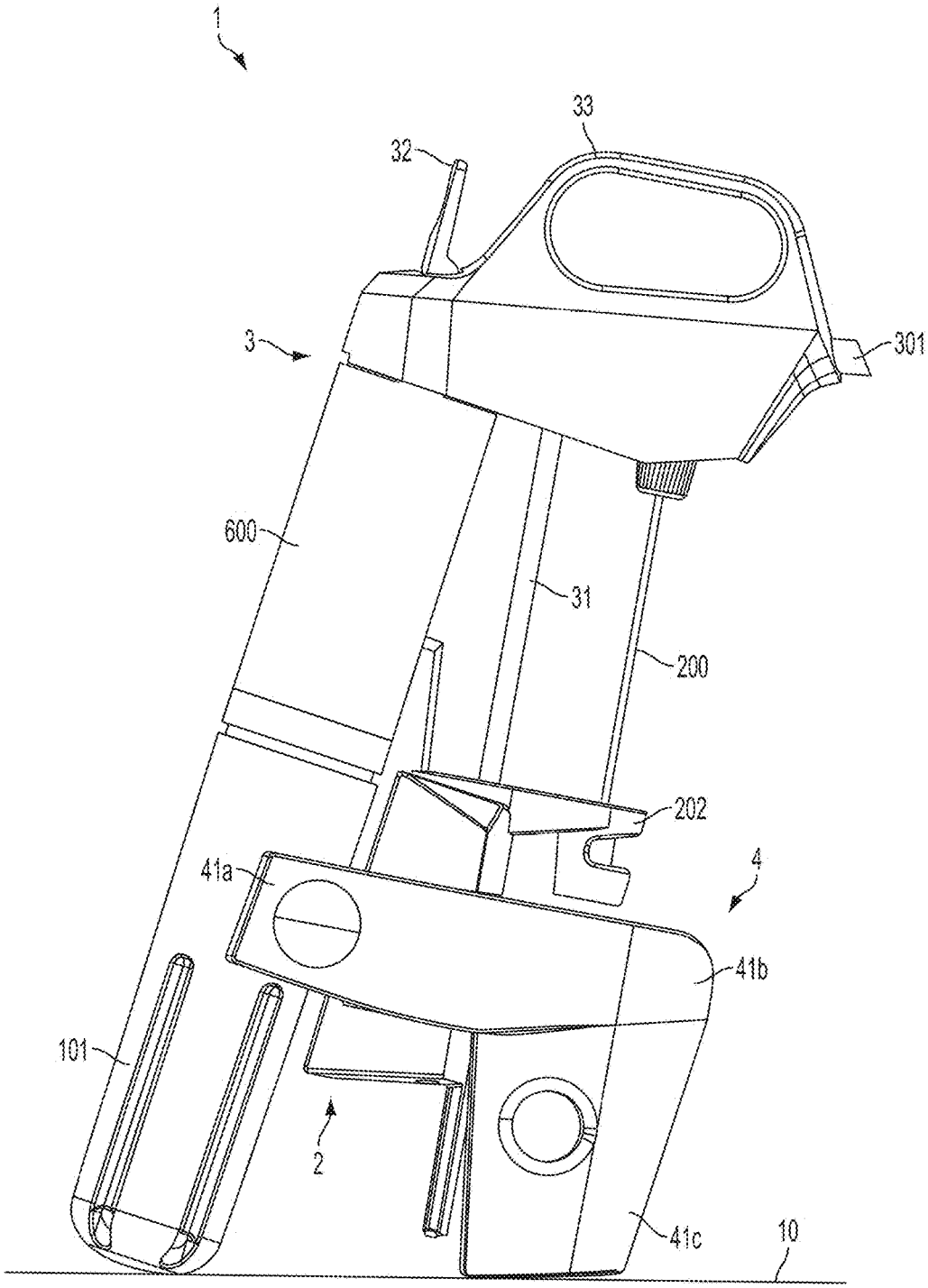
FIG. 5 shows a side view of a beverage extraction device having a clamp arrangement for supporting the device in an upright orientation in an illustrative embodiment.
Figure 6:
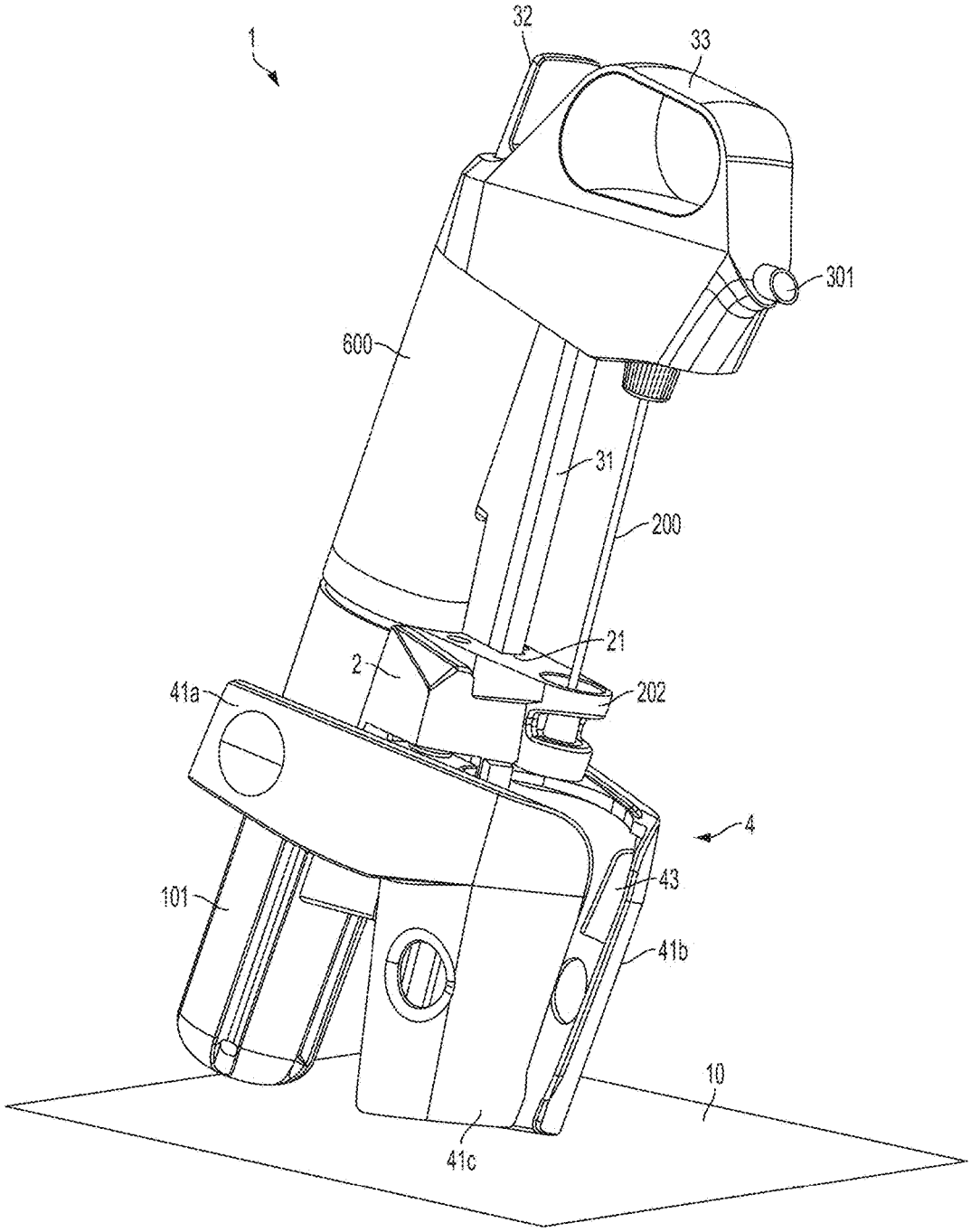
FIG. 6 shows a front perspective view of the FIG. 5 embodiment.
Figure 9:
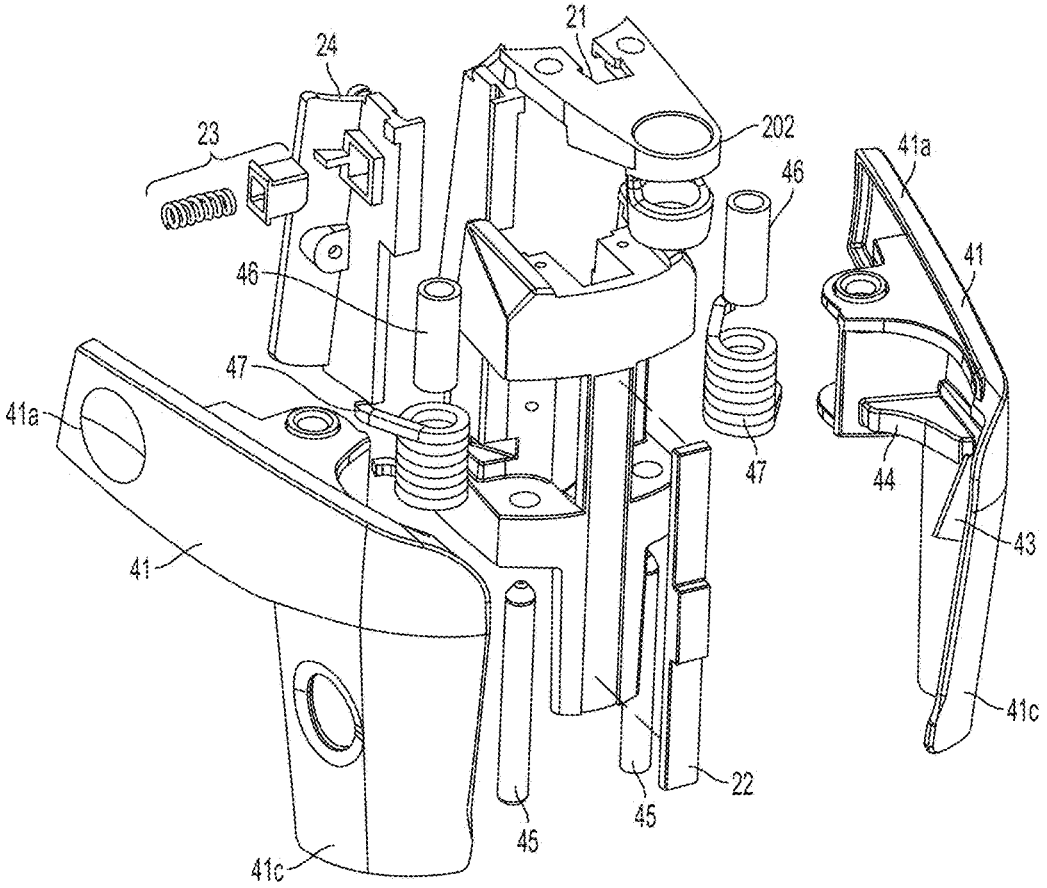
FIG. 9 shows an exploded view of the base in the FIG. 5 embodiment.

Also included in this embodiment is a clamp 4 having a pair of clamp arms 41 that are arranged to support the device 1 on a container neck. (It should be appreciated, however, that a single clamp arm may be provided instead of a pair, as described in more detail below.) In FIG. 5, the device 1 is shown standing upright on a surface 10 supported by downwardly extending portions 41*c* of the clamp arms 41 and a lower portion of the cover 101 on a surface 10 such as a table top, although this feature is not necessary. That is, the downwardly extending portions 41*c* for supporting the device 1 while are standing upright are not required, although these portions may help the clamp 4 better engage a container neck even if not arranged to support the device 1 in an upright position. In this illustrative embodiment, the clamp arms 41 are pivotally mounted to the base 2 such that the distal portions 41*b* are normally biased to move toward each other, e.g., to clamp a bottle neck positioned between the arms 41. For example, as shown in FIG. 9, the clamp arms 41 are mounted to the base 2 via pivot pins 45 and bushings 46. However, the clamp arms 41 may be movably mounted relative to the base 2 in other ways, such as by a linkage, living hinge, a sliding engagement (such as by having a portion of a clamp arm move in a channel of the base), and others. Also, one arm may be fixed to the base while the other is made movable (although in such an embodiment the arms are still said to be moveable relative to each other). Torsion or other springs 47 may be used to provide the biasing force (if provided at all) on the clamp arms 41. For example, in this embodiment, torsion springs 47 are mounted over the bushings 46 and are arranged to engage the base 2 and a clamp arm 41 so that the clamp arms are biased to move the distal portions 41*b* toward each other. This clamping force of the clamp arms 41 may be sufficiently robust to support the device 1 on the container 700, or even to allow a user to lift and pour beverage from the container 700 by grasping and manipulating the device 1.

Figure 10:
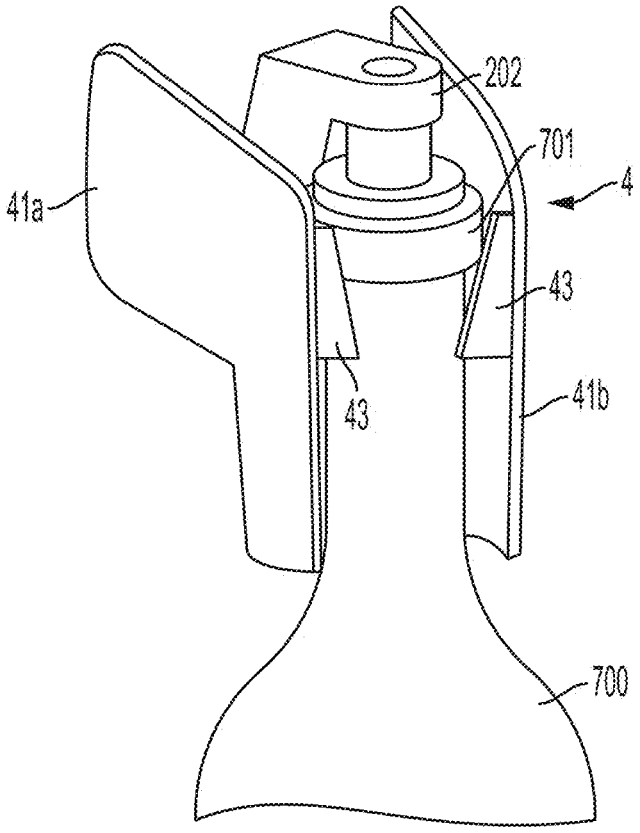
FIG. 10 shows a front view of the FIG. 5 embodiment engaged with a container neck.

The clamp arms 41 may also include proximal portions 41*a* that can be grasped by a user and moved together (overcoming the biasing force of the springs 47) so that the distal portions 41*b* are moved away from each other to receive a bottle neck. For example, in this embodiment, a user may pinch the proximal portions 41*a* together to position a bottle neck between the distal portions 41*b*, and then release the proximal portions 41*a* to allow the clamp arms 41 to clamp the bottle neck, e.g., as shown in FIG. 10. However, other arrangements are possible. For example, the distal portions 41*b* may instead be biased to move away from each other and move toward each other when a user applies suitable force, e.g., to the distal portions 41*b*, to overcome the biasing force. In another embodiment, the clamp arms 41 need not be spring biased at all. In such arrangements where the clamp arms 41 are biased to move the distal portions 41*b* apart or are not biased at all, a locking mechanism may be used to engage the clamp arms 41 to the container.

That is, whether the clamp arms 41 are spring biased or not, movement of the arms relative to each other may be restricted or otherwise controlled in some way by a locking mechanism. For example, the arms 41 may be secured together by a ratchet and pawl mechanism that allows the distal portions 41*b* of the clamp arms 41 to move freely toward each other, but prevents movement of the distal portions 41*b* away from each other unless the pawl is first cleared from the ratchet. This arrangement may allow a user to securely clamp the arms 41 onto a bottle neck with the ratchet and pawl ensuring that the arms 41 will not move away from each other to release the neck until the user releases the pawl. In other embodiments, the arms 41 may be secured against movement away from each other in alternate ways, such as by a buckle and strap (with the strap secured to one arm 41 and the buckle secured to the other arm 41), a screw and nut (in which the screw engages one arm 41, the nut engages the other arm 41, and the screw and nut threadedly engage each other to secure the arms 41 together), a hook-and-loop closure element that spans across the arms 41 at their distal end, or other arrangement suited to engage the arms 41 with the container 700. A locking mechanism need not fix the arms 41 relative to each other, but instead may resist relative movement to at least some extent, and may allow for some movement of the arms 41, e.g., away from each other even when the locking mechanism is engaged.

In accordance with an aspect of the invention, one or both of the clamp arms 41 include a container engagement feature 43 that can aid in disengaging the clamp arms 41 from the container neck. In this embodiment, the engagement features 43 extend vertically and each have a sloped surface that faces toward the container neck and that slopes outwardly and upwardly relative to the container neck. For example, in some embodiments the device 1 includes a needle 200 that defines a vertical axis and the engagement surfaces 43 may be arranged at an angle relative to the vertical axis and slope upwardly and outwardly relative to the vertical axis. As can be seen in FIG. 10, the engagement surfaces 43 may face toward a lip 701 of the container neck and may contact the lip 701 to exert a radially inward force on the lip (or not contact the lip at all) when the clamp arms 41 are fully engaged with the container neck and the needle guide 202 or other stop is in contact a top of the container. If a upward force is exerted on the base 2 which moves the clamp arms 41 upwardly relative to the container 700, the engagement surfaces 43 may contact the lip 701 so that the lip 701 moves the engagement surfaces 43, and thus the clamp arms 41, radially outward and away from the container neck. This may help disengage the clamp 4 from the container and removal of the device 1 from the container 700. In some embodiments, a user may grasp the handle 33 of the body 3 and pull upwardly on the body 3 to remove the needle 202 from a cork or other closure. The base 2 and the clamp 4 may initially remain stationary relative to the container as the needle 202 is withdrawn. However, once the body 3 reaches its uppermost position relative to the base 2, continued upward force on the handle 33 will pull the base 2 and clamp 4 upwardly relative to the container 700. At this point the engagement surfaces 43 may engage the lip 701 or other container portion and urge the clamp arms 41 outwardly to disengage the container neck.

Figure 7:
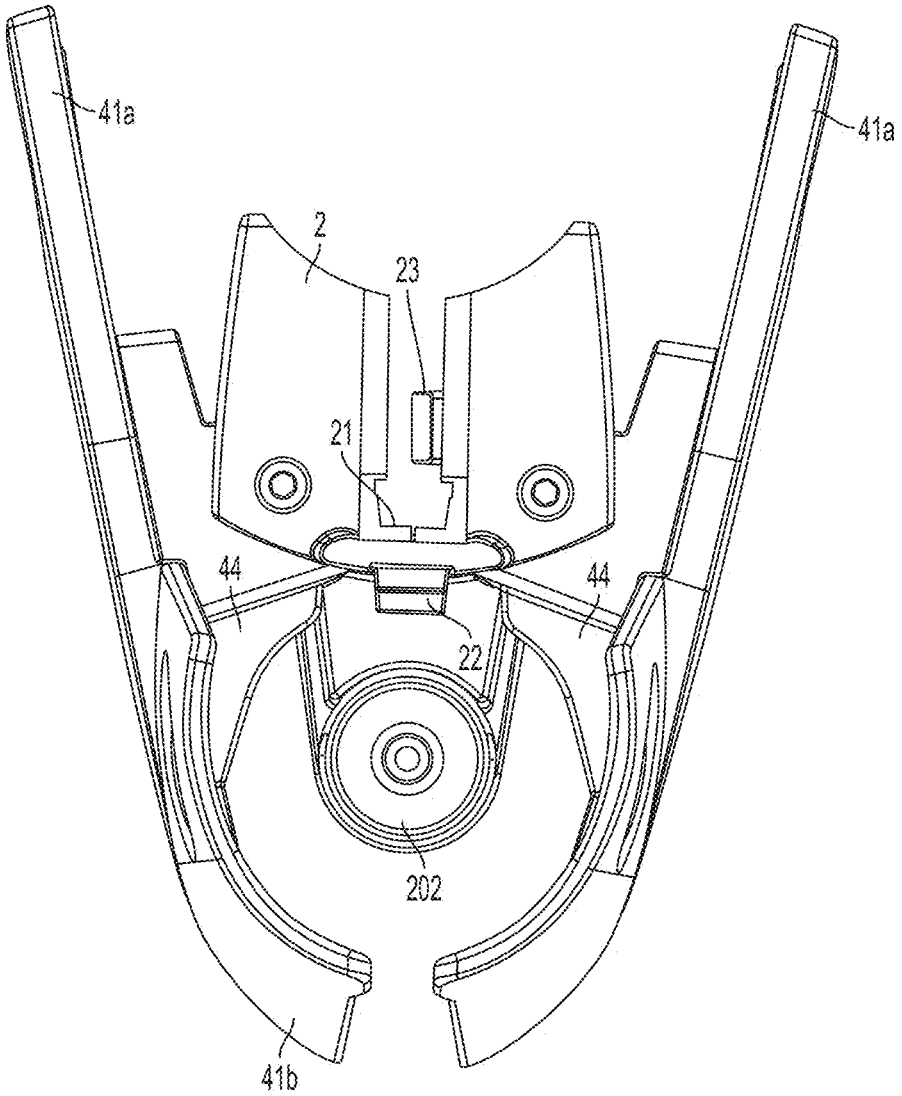
FIG. 7 shows a bottom view of the clamp arms of the FIG. 5 embodiment.
Figure 8:
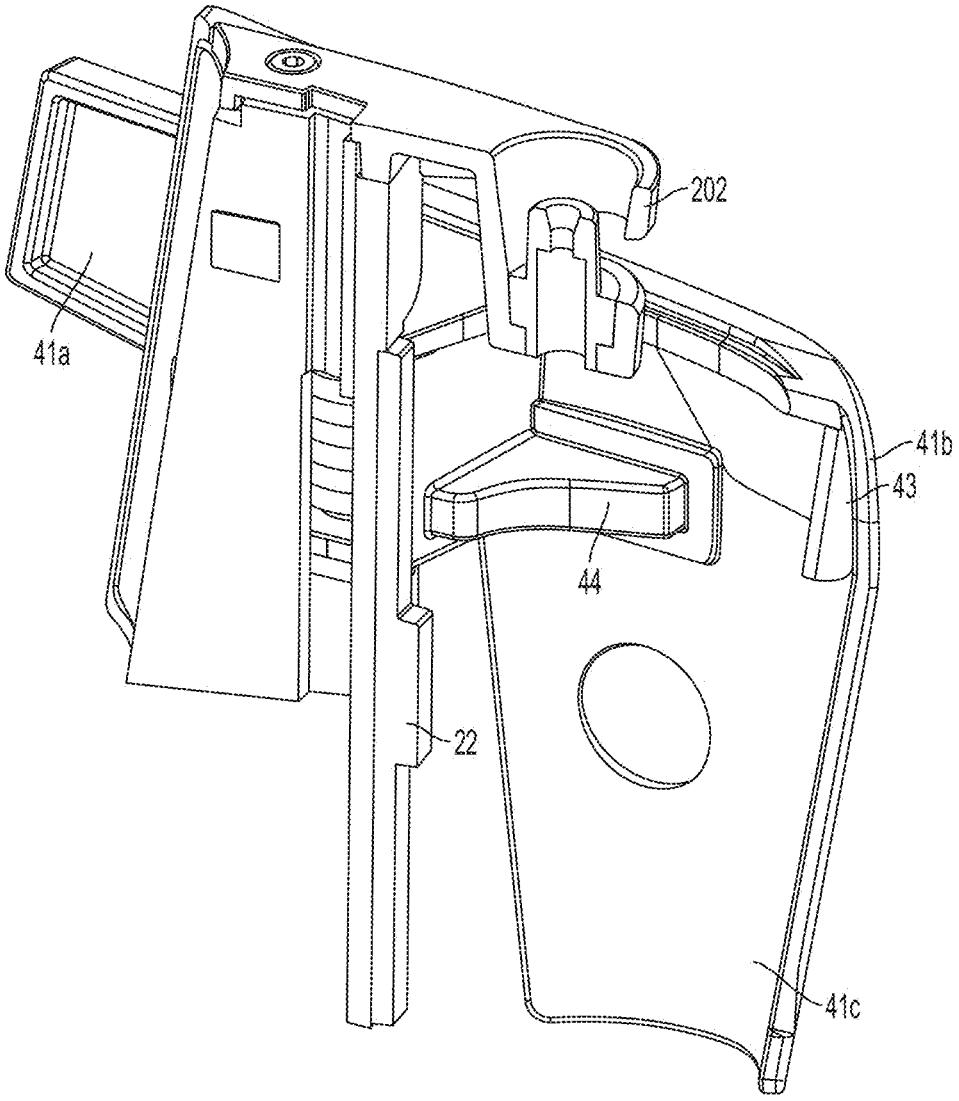
FIG. 8 shows a side view of an inner surface of a clamp arm of the FIG. 5 embodiment.

The engagement surface 43 may be useful in embodiments when some portion of the clamp 4 may impede or otherwise resist removal of the clamp 4 from the container neck. For example, in this embodiment, the clamp arms 41 each include a ridge 44 that may contact the container neck and help secure the clamp 4 to the container. The ridges 44 may have a length measured in a direction perpendicular to a bottle neck (or in a direction perpendicular to the length of the needle 200) to help the ridge 44 provide a suitably long contact surface for the container neck. For example, the ridges 44 may contact an underside of the bottle lip 701 with a suitably long surface to help prevent the neck from moving downwardly relative to the clamp arms 41 more than a desired distance. The extended length of the ridges 44 may provide the ridges 44 with greater strength and help the clamp arms 41 operate with a wide array of bottle neck and lip sizes and shapes. In addition, the ridges 44 may have a variable radial length, e.g., increasing in radial length in a proximal direction as shown in FIG. 7, to help ensure that the ridges 44 will provide suitable engagement with a variety of different necks having different lip dimensions. Of course, ridges 44 are not required and may be eliminated or revised in shape, location or size.

As noted above, the ridges 44 may be positioned below the lip 701 in some cases when the needle guide 202 is on the top of the container neck and the clamp arms 41 are fully engaged with the container neck. This position of the ridges 44 below the lip 701 may help stabilize the device 1 during use, e.g., by contacting portions of the container neck below the lip 701. However, the ridges 44 may also contact the lip 701 and prevent removal of the clamp arms 41. To help release the container neck from the ridges 44, the engagement surfaces 43 may move the arms 41 radially outwardly so that the ridges 44 clear the lip 701 in a radial direction and the clamp arms 41 can be lifted upwardly relative to the container neck and removed from the container 700. In addition to aiding in the removal of the clamp 4 from a container, the engagement surfaces 43 may engage the container neck when the device 1 is fully engaged with the container 700 for dispensing, and exert a radially inward force on the container neck that helps secure the device to the container 700. Alternately, the engagement surfaces 43 may not contact the container neck including the lip 701 when the device 1 is engaged for dispensing, and instead the surfaces 43 may contact the container neck, e.g., the lip 701, only at the time of removal when the clamp 4 is moved upwardly relative to the container 700.

As will be understood by those of skill in the art, different bottles or containers may have different neck diameters or lengths, different lip diameters or lengths (as used herein, a lip is a feature of many wine bottles near the top of the neck in which the bottle flares, steps or otherwise protrudes outwardly in size), or otherwise vary in configuration in an area where the clamp 4 engages the container 700. By arranging the engagement surfaces 43 at a distal end of the clamp arms 41 or otherwise positioning the engagement surfaces 43 more distally than a ridge 44, the engagement surfaces 43 and the ridge 44 may accommodate a wider variety of sizes and shapes of container neck features. By having the engagement surfaces 43 contact the container neck at a distal location and the ridges 44 contact at a proximal location, the clamp 4 can operate with a wider range of neck diameters because the clamp arms 41 need only contact the container neck at four locations (one for each of the engagement surfaces 43 and the ridges 44). Also, irregular surfaces on the container neck, necks having non-circular cross sectional shapes, etc., can be suitably engaged to secure the device 1 on the container 700. The engagement surfaces 43 and the ridges 44 may also help to center the bottle neck or otherwise appropriately position the neck relative to the clamp arms 41. For example, as the clamp arms 41 are closed on a neck, the engagement surfaces 43 and ridges 44 may contact the neck so that a center of the cork or other closure 730 can be pierced by the needle 200. In some embodiments, the engagement surfaces 43 and/or the ridges 44 may have portions that contact the container neck with a relatively hard, low-friction surface. Allowing relatively friction-free contact between the engagement surfaces 43 and the container neck (such as at the lip 701) may aid in easier removal of the clamp 4 from the container 700 when the clamp 4 is lifted upwardly relative to the container 700.

In another aspect of the invention, the engagement surfaces 43 may help urge the neck proximally relative to the base 2, e.g., to move the neck toward a pad 22 located on the base 2 between the clamp arms 41. By urging the neck to move proximally and into contact with the pad 22 or other component, the clamp arms 41 may help position the neck in a consistent way relative to the needle guide 202 and the needle 200. This may help ensure that the needle 200 penetrates the closure 730 in a desired location. For example, the needle guide 202 and needle 200 may be arranged to pierce a closure 730 in a location that is offset from a center of the closure 730 with the neck positioned in contact with the pad 22. This may help avoid having the needle 200 penetrate the closure in the same location if the device 1 is used two or more times to extract beverage from the same container 700. (As noted above, beverage can be extracted without removal of the closure 730, and since the closure can reseal after removal of the needle, beverage can be extracted multiple times from a container 700 without removal of the closure 730, although the closure 730 may be pierced several times to do so.) Alternately, the needle 200 and guide 202 may be configured to penetrate a closure at its center with the neck in contact with the pad 22, and by positioning the neck proximally and in contact with the pad 22, the closure 730 may be penetrated at the center as desired. In another arrangement in which the device is arranged to penetrate the closure 730 at a center position, the clamp arms 41 may each include semi-circular or other suitably arranged surfaces that contact the neck so the center of the closure 730 is always positioned for penetration by the needle 200.

The pad 22 in this illustrative embodiment includes a strip of resilient material, such as a rubber, that can help the device 1 grip the bottle neck when engaged by the clamp arms 41. In some embodiments, the pad 22 may include a protrusion or step near a lower portion of the pad 22 (see FIGS. 8 and 9) so that the pad 22 can engage with a lower surface of a lip 701 on a bottle neck, e.g., similarly to the ridge 44. The pad 22 may extend in a direction along the length of the needle, i.e., along a length of the bottle neck, and may have any suitable length. Generally, however, the pad 22 will have a length that is equal to or shorter than a length of the shortest bottle necks to be engaged by the device 1. Similar is true of the clamp arms 41. That is, the clamp arms 41 may have distal portions 41*b* that extend downwardly, in a direction along the length of the needle 200, to an extent that allows the clamp arms 41 to receive and engage bottles that have a somewhat short neck. In one embodiment, the distal portions 41*b* of the clamp arms 41 may extend downwardly at least to an extent equal to or greater than a lowermost position of the distal end of the needle 200 when the body 3 is positioned at a lowermost position relative to the base 2. In this way, the needle 200 may be prevented from contacting a surface 10 when the body 3 is in a lowermost position relative to the base 2. Also, the needle 200 may be movable relative to the clamp arms 41 to be positioned within a space between the clamp arms 41 throughout its full range of movement.

In this embodiment, the device 1 includes a detent that resiliently holds the body 3 in an upper position relative to the base 2, e.g., to help ensure that the body 3 does not move relative to the base 2 when at the upper position. For example, the detent may include a spring-loaded ball or other element mounted on the base 2 that engages with a suitable groove on the body 3 to hold the body 3 and base 2 stationary relative to each other until suitable force is exerted to overcome the detent holding function. See, for example, FIG. 9 which shows a detent 23 that includes a spring loaded plunger mounted to the base 2 that is arranged to engage with a groove or other feature on the rail 31 of the body 3. The detent 23 may help keep the body 3 in the upper position relative to the base 2 while the base 2 is secured to a container 700 by the clamp 4. This way, the needle 200 or other portions of the body 3 will not interfere with mounting of the device on the container 700. With the device 1 suitably engaged, the body 3 may be moved downwardly to insert the needle 200 into the closure 730. Other detent arrangements are possible, such as a spring-loaded tab and slot, and others as will be appreciated by those of skill in the art. Moreover, a detent is not required to releasably hold the body 3 and base 2 in one or more positions relative to each other. For example, a friction element (such as a rubber strip positioned between the rail 31 and channel 21) may be included to provide a friction force that maintains the body and base stationary in the absence of a force over a threshold level. The friction element may provide the friction force for specific body/base positions, or throughout the full range of body/base movement. (As one example, the guides 24 shown in FIG. 9 that form part of the channel 21 may include portions that contact the rail 31 of the body 3 to provide suitable friction in movement of the rail 31 in the channel 21.) Other configurations are possible to help hold the body 3 and base 2 in one or more positions relative to each other, such as a spring-loaded pin, latch or other lock, a thumbscrew on the base 2 that can be tightened to engage the rail 31 and prevent body/base movement, etc.

Figure 11:
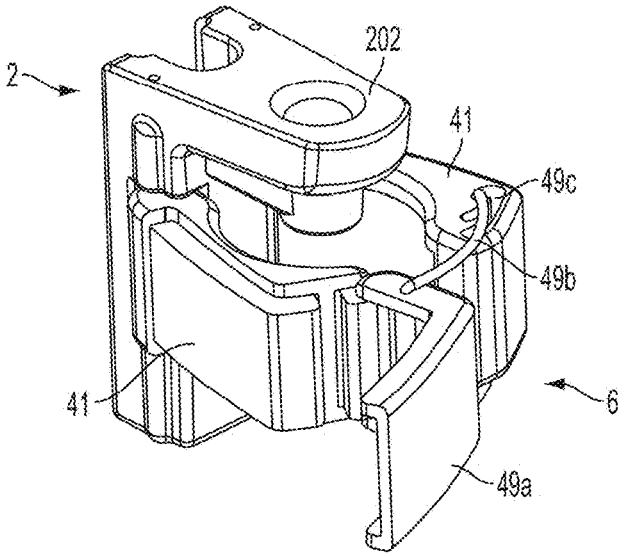
FIG. 11 shows a perspective view of a locking mechanism for a clamp in an illustrative embodiment in an open condition.
Figure 12:
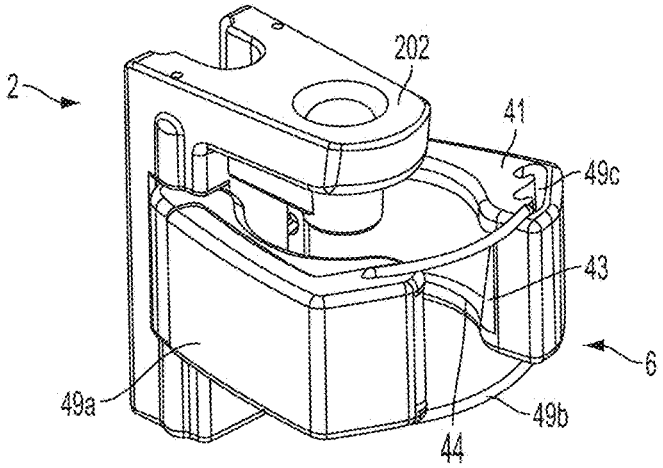
FIG. 12 shows the FIG. 11 embodiment with the clamp in a closed condition.

As noted above, engagement surfaces used to help disengage a clamp of an extraction device 1 may be arranged in different ways and with different clamp arrangements. For example, FIGS. 11 and 12 show an illustrative embodiment in which the clamp 4 includes clamp arms 41 with a locking mechanism 6 in the form of a buckle similar to that found in some ski boots. In this embodiment, the locking mechanism 6 includes a handle 49*a* that is pivotally mounted to a clamp arm 41 and carries a bail 49*b*. The bail 49*b* is arranged to selectively engage with one of the bail-engaging slots 49*c* formed in the other clamp arm 41. Accordingly, the locking mechanism 6 in this embodiment is arranged to provide three different positions of the bail 49*b* on the bail-engaging slots 49*c*, thus allowing the locking mechanism to provide three different adjustment positions for engaging different sized container necks. To engage the clamp arms 41 to a neck, the bail 49*b* is engaged with a suitable slot 49*c*, and the handle 49*a* is rotated to lock the clamp arms 41 is place. Of course, other locking mechanisms are possible. Thus, the clamp 4 may include a locking mechanism that has a single locking position, multiple locking positions, a continuously variable locking position, a series of indexed or stepped locking positions, and/or a user defined locking position. Such clamp arm securing arrangements may be used whether the distal portions 41*b* of the clamp arms 41 are biased to move toward each other, away from each other, or with no bias at all.

In this embodiment, the clamp arms 41 also includes ridges 44 that may be positioned below a lip 701 of a container and may help resist movement of the lip 701 past the ridges 44 in a downward direction. However, even with the locking mechanism 6 disengaged, the ridges 44 may interfere with removal of the clamp 4 from the container neck by lifting of the clamp 4 upwardly relative to the container 700. Engagement surfaces 43 may be provided on the clamp arms 41 as shown, e.g., at a distal end of the clamp arms 41 or at one or more locations along the clamp arm 41 and arranged to extend vertically and to slope upwardly and outwardly relative to a container neck's longitudinal axis, a vertical axis and/or a longitudinal axis of a needle 200. With this arrangement, as the clamp 4 is moved upwardly relative to the container neck, the engagement surfaces 43 may move help guide a lip 701 of the container neck past the ridges 44 so the clamp can be removed from the container. The engagement surfaces 43 may operate in this fashion even with the locking mechanism 6 engaged, provided there is enough space to fit a lip 701 of the container past the ridges 44. In some embodiments, the engagement surfaces 43 may be rigid and may contact the container 700 when the locking mechanism 6 is engaged. In other arrangements, the engagement surfaces 43 may be resilient, such as by making the surfaces 43 as part of a resilient material (such as an elastomer or spring metal), or by arranging the surfaces 43 to move with force applied to the surfaces 43 over a particular threshold (such as by making the surfaces 43 of a rigid material that is pivotally mounted to the clamp arms 41 at an upper end. A spring or other element may bias the surfaces 43 to pivot outwardly to provide a suitable force on the container neck to help with clamp 4 removal, but retract when the clamp is engaged with the neck.) In this way, the engagement surfaces 43 may retract or otherwise move to allow the clamp arms 41 to securely engage the container neck when the locking mechanism 6 is tightly engaged, yet recover to provide a suitable guiding force, biasing force on the clamp arms to move toward an open position or otherwise aid in removal of the clamp 4 with the locking mechanism 6 is disengaged.

When employing a needle with an extraction device 1, it has been found that needles having a smooth walled exterior, pencil point or Huber point of 16 gauge or higher are effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the container and any remaining beverage to be stored for months or years without abnormal alteration of the beverage flavor (such as when an inert or otherwise suitably non-reactive or low-reactive gas is injected into the container during dispensing). While multiple needle gauges can work, preferred needle gauges range from 16 to 22 gauge, with an optimal needle gauge in some embodiments being between 17 and 20 gauge. These needle gauges may offer optimal fluid flow with minimal pressures inside the container while doing an acceptably low level of damage to the cork even after repeated insertions and extractions. Further, such needles may be used to penetrate a foil cover or other wrapping commonly found on wine bottles and other containers. Thus, the needle may penetrate the foil cover or other element as well as the closure, eliminating any need to remove the foil or other wrapping prior to beverage extraction. Other needle profiles and gauges are also usable with the system, or no needle at all. For example, an extraction or dispensing device 1 may include a blunt conduit that is positioned in a container after a cork or other closure is removed. The conduit may be used with a reusable stopper through which the conduit is inserted and that sealingly engages with the container at the opening (e.g., in a way similar to how a bottle cork sealingly engages at the container opening). In other arrangements, the conduit may be part of a cap, such as a screw-on cap, that can be engaged with a container. Also, if a needle is used, it need not be arranged to allow for cork resealing after removal. Instead, a needle may form an opening in a cork that is too large to allow the cork to reseal.

While in the above embodiments, a user moves the body 3 in a linear fashion relative to the base 2 to insert/remove a needle with respect to a container closure, a manual or powered drive mechanism may be used to move a needle relative to a closure. For example, a rail 31 may include a toothed rack, while the base 2 may include a powered pinion gear that engages the rack and serves to move the body 3 relative to the base 2. The pinion may be powered by a user-operated handle, a motor, or other suitable arrangement. In another embodiment, the needle may be moved by a pneumatic or hydraulic piston/cylinder, e.g., which is powered by pressure from the gas cylinder 100 or other source. Also, a body 3 and/or needle 200 need not be movable relative to a base 2 and clamp 4. Instead, the body 3 and/or needle 200 may be fixed relative to a clamp, e.g., a needle may be inserted through a cork and then the clamp 4 engaged with the container neck.

Multiple needle lengths can be adapted to work properly in various embodiments, but it has been found that a minimum needle length of about 1.5 inches is generally required to pass through standard wine bottle corks. Needles as long as 9 inches could be employed, but the optimal range of length for some embodiments has been found to be between 2 and 2.6 inches. (Needle length is the length of a needle that is operable to penetrate a closure and/or contact a needle guide for guidance in moving through the closure.) The needle may be fluidly connected to the valve directly through any standard fitting (e.g. NPT, RPT, Leur, quick-connect or standard thread) or alternatively may be connected to the valve through an intervening element such as a flexible or rigid tube. When two or more needles are used, the needle lengths may be the same or different and vary from 0.25 inches to 10 inches. Creating distance between the inlet/outlets of the needles can prevent the formation of bubbles.

In some embodiments, a suitable gas pressure is introduced into a container to extract beverage from the container. For example, with some wine bottles, it has been found that a maximum pressure of between around 40 and 50 psi may be introduced into the bottle without risking leakage at, or ejection of, the cork, although pressures of between around 15 and 30 psi have been found to work well. These pressures are well tolerated by even the weakest of cork-to-bottle seals at the bottle opening without causing cork dislodging or passage of liquid or gas by the cork, and provide for relatively fast beverage extraction. The lower pressure limit in the container during wine extraction for some embodiments has been found to be between about 0 and 20 psi. That is, a pressure between about 0 and 20 psi has been found needed in a bottle to provide a suitably fast extraction of beverage from the bottle. In one example using a single 17 to 20 gauge needle, a pressure of 30 psi was used to establish an initial pressure in a wine bottle, and rapid wine extraction was experienced even as the internal pressure dropped to about 15-20 psi.

The source of pressurized gas can be any of a variety of regulated or unregulated pressurized gas containers filled with any of a variety of non-reactive gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the container, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

The embodiment above, a single needle with a single lumen is used to introduce gas into the container and extract beverage from the container. However, in other embodiments two or more needles may be used, e.g., one needle for gas delivery and one needle for beverage extraction. In such an embodiment, the valve 300 may operate to simultaneously open a flow of gas to the container and open a flow of beverage from the container. The needles may have the same or different diameters or the same or different length varying from 0.25 to 10 inches. For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A beverage dispensing device, comprising:

a body including a conduit arranged to receive a flow of beverage under pressure from a beverage container and to dispense the beverage at a dispensing outlet of the conduit; and a clamp arranged to engage a container neck to secure the body relative to the container neck, the clamp including a container engagement surface that slopes outwardly and upwardly relative to the container neck and is arranged to disengage the clamp from the container neck as the clamp is pulled upwardly relative to the container neck.

2. The device of claim 1, wherein the container engagement surface is arranged to contact a lip of a container and exert a radially outward force on the clamp to move the clamp away from the lip of the container as the clamp is moved upwardly relative to the container neck.

3. The device of claim 1, wherein the container engagement surface is arranged to contact the container neck and exert a radially inward force on the container neck.

4. The device of claim 1, wherein the clamp includes at least one arm arranged to engage with the container neck, and wherein the container engagement surface extends vertically on the at least one arm.

5. The device of claim 4, wherein the clamp arm includes two arms that are opposed to each other and arranged to engage the container neck with the container neck positioned between the arms, each arm including a container engagement surface that extends vertically on the respective arm.

6. The device of claim 5, further comprising a base, wherein the two arms are movably mounted to the base such that the arms can be moved towards and away from each other.

7. The device of claim 6, wherein the base includes a stop arranged to contact a top of the container neck positioned between the arms, wherein the arms are pivotally mounted to the base on a proximal side of the arms and the container engagement surfaces are located on a distal side of the arms.

8. The device of claim 7, wherein the arms are spring biased to move toward each other.

9. The device of claim 6, wherein the body is mounted for slidable movement relative to the base.

10. The device of claim 9, the body further including a needle extending downwardly from the body and arranged for insertion through a closure of the container.

11. The device of claim 9, wherein upward force on the body moves the body upwardly relative to the base, and moves the base and arms upwardly relative to a container neck engaged by the arms.

12. The device of claim 1, the body further including a needle extending vertically downwardly from the body and arranged for insertion through a closure of the container, wherein the container engagement surface is arranged to slope upwardly and outwardly relative to the needle.

13. The device of claim 12, further comprising a base that includes the clamp, the body being movable vertically relative to the base.

14. The device of claim 13, the base further including a needle guide arranged to contact a top of a container neck engaged by the clamp, wherein the needle guide is arranged to guide movement of the needle through the closure with downward movement of the body relative to the base.

15. The device of claim 13, wherein the clamp includes at least one arm movable relative to the base and that includes the container engaging surface.

16. The device of claim 1, further comprising a source of pressurized gas arranged to deliver pressurized gas into a beverage container, wherein the conduit is fluidly coupled to the beverage container to receive the flow of beverage under pressure caused by the pressurized gas in the beverage container.

17. The device of claim 16, further comprising a valve arranged to control a flow of pressurized gas into the beverage container or to control the flow of beverage under pressure from the beverage container.

18. The device of claim 17, further comprising a needle arranged to be inserted through a closure of a beverage container to deliver the pressurized gas into the beverage container and to deliver beverage under pressure from the beverage container to the conduit.

* * * * *